US011592761B1

(12) United States Patent
Kasukawa

(10) Patent No.: US 11,592,761 B1
(45) Date of Patent: Feb. 28, 2023

(54) IMAGE FORMING APPARATUS WITH ADJUSTABLE DOCTOR BLADE

(71) Applicant: TOSHIBA TEC KABUSHIKI KAISHA, Tokyo (JP)

(72) Inventor: Masayuki Kasukawa, Misato Saitama (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/584,445

(22) Filed: Jan. 26, 2022

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01)

(58) Field of Classification Search
CPC ..... G03G 15/0812; G03G 15/0921
See application file for complete search history.

(56) References Cited

U.S. PATENT DOCUMENTS 4,457,257 A * 7/1984 Murakami ..... G03G 15/095 399/264
4,548,490 A * 10/1985 Stirrat ..... G03G 15/0914 399/272
5,303,010 A * 4/1994 Takano ..... G03G 15/09 399/284

FOREIGN PATENT DOCUMENTS

| | | | |
|---|---|---|---|
| JP | 01-219859 | | 9/1989 |
| JP | 04-246671 | | 9/1992 |
| JP | 2003241507 A | * | 8/2003 |
| JP | 2009-175360 | | 8/2009 |
| JP | 2017-072762 | | 4/2017 |

* cited by examiner

*Primary Examiner* — Walter L Lindsay, Jr.
*Assistant Examiner* — Milton Gonzalez
(74) *Attorney, Agent, or Firm* — Amin, Turocy & Watson, LLP

(57) ABSTRACT

An image forming apparatus includes a developing case housing a developer. A doctor blade is separated from an outer surface of a developing sleeve, the both ends of the doctor blade in a longitudinal direction are fixed to a developing case, and the doctor blade includes a through hole in the central portion in the longitudinal direction. An adjusting portion adjusts the distance between the doctor blade and the outer surface of the developing sleeve. A rotating portion is provided on one surface of the base portion, inserts the through hole, and rotates with respect to the doctor blade and the developing case.

20 Claims, 15 Drawing Sheets

IMAGE FORMING APPARATUS WITH ADJUSTABLE DOCTOR BLADE

FIELD

Embodiments described herein relate generally to an image forming apparatus.

BACKGROUND

An image forming apparatus receives toner from a toner cartridge and performs an image forming process of forming a toner image on a photoconductive drum. The image forming apparatus transfers the toner image of the photoconductive drum to the printing medium.

DETAILED DESCRIPTION

In general, according to one embodiment, an image forming apparatus includes a developing case, a developing sleeve, a doctor blade, and an adjusting portion. The developing case contains a developer containing a carrier and toner supplied from a toner cartridge. Both ends of the developing sleeve are supported by the developing case, and the developer adheres to the outer surface of the developing sleeve by magnetic force. The doctor blade is separated from the outer surface of the developing sleeve, both ends of the doctor blade in a longitudinal direction are fixed to the developing case, and the doctor blade includes a through hole in the central portion in the longitudinal direction. The adjusting portion adjusts the distance between the doctor blade and the outer surface of the developing sleeve. The adjusting portion includes a plate-shaped base portion, a shaft-shaped rotating portion, and a cam. The rotating portion is provided on one surface of the base portion, inserts the through hole, and rotates with respect to the doctor blade and the developing case. The cam is provided on the other surface of the base portion and fits into the developing case to adjust the position of the doctor blade with respect to the developing case in response to the rotation of the rotating portion.

Hereinafter, an image forming apparatus 1 according to an embodiment will be described with reference to drawings.

Figure 1:
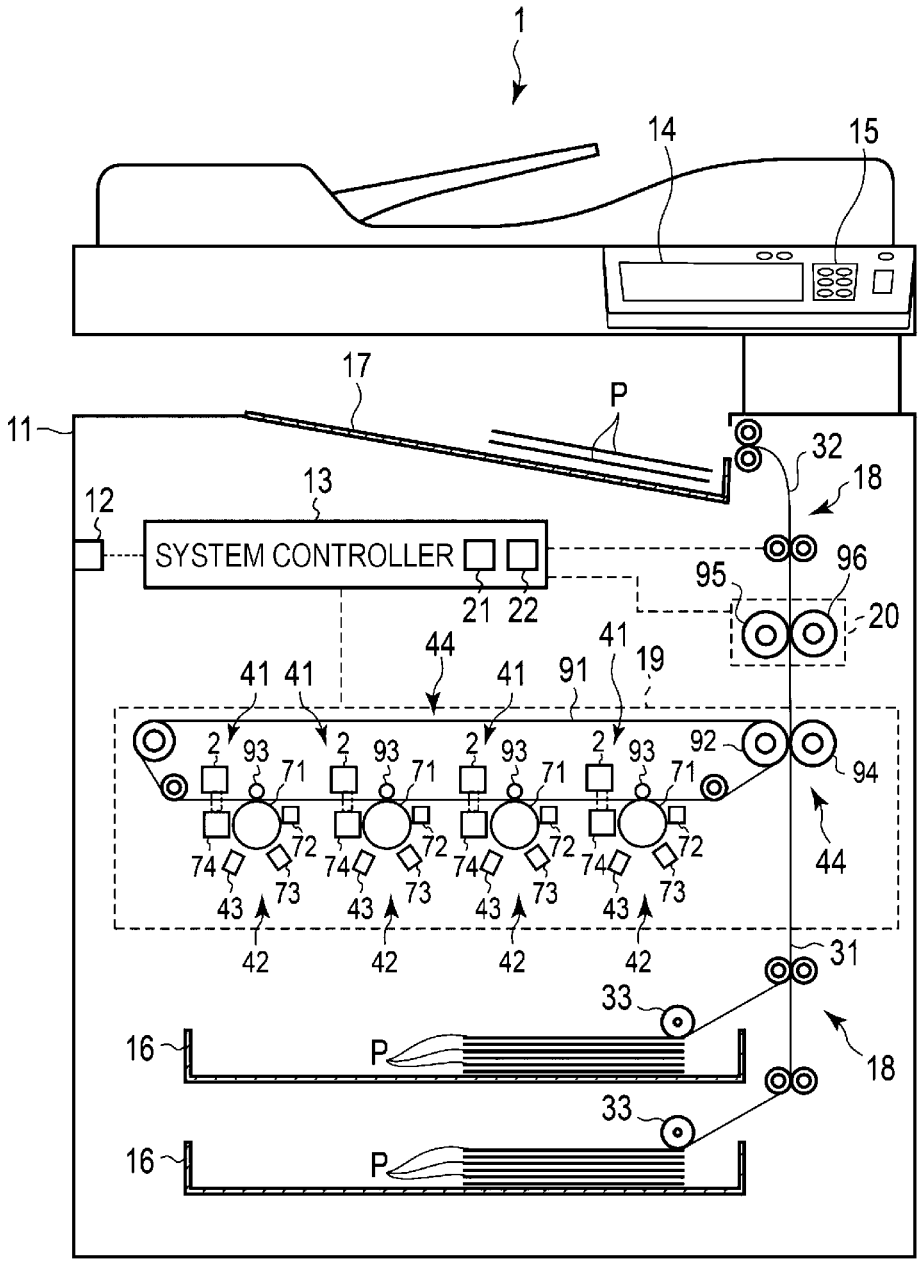
FIG. 1 is a view illustrating a configuration example of an image forming apparatus according to an embodiment.

FIG. 1 is an explanatory view illustrating a configuration example of the image forming apparatus 1 according to the embodiment.

The image forming apparatus 1 is, for example, a multifunction printer (MFP) that performs various processing such as image forming while transporting a recording medium such as a printing medium. The image forming apparatus 1 is, for example, a solid-state scanning printer (for example, an LED printer) that scans an LED array that performs various processing such as forming an image while transporting a recording medium such as a printing medium.

For example, the image forming apparatus 1 receives toner from a toner cartridge 2 and forms an image on a print medium by the received toner. The toner may be a monochromatic toner, or may be a color toner having a color such as cyan, magenta, yellow, or black.

As illustrated in FIG. 1, the image forming apparatus 1 includes a housing 11, a communication interface 12, a system controller 13, a display unit 14, an operation interface 15, a plurality of paper trays 16, a paper discharge tray 17, a transport unit 18, an image forming unit 19, and a fixer 20.

The housing 11 is the main body of the image forming apparatus 1. The housing 11 houses the communication interface 12, the system controller 13, the display unit 14, the operation interface 15, the plurality of paper trays 16, the paper discharge tray 17, the transport unit 18, the image forming unit 19, and the fixer 20.

The communication interface 12 is an interface for communicating with other devices. The communication interface 12 is used, for example, for communication with a host device (external device). The communication interface 12 is, for example, a LAN connector or the like. Further, the communication interface 12 may perform wireless communication with other devices according to the standard.

The system controller 13 controls the image forming apparatus 1. That is, the system controller 13 controls the communication interface 12, the display unit 14, the operation interface 15, the transport unit 18, the image forming unit 19, and the fixer 20.

The system controller 13 performs various processing based on data such as a program stored in a memory. The system controller 13 performs various information processing by executing a program stored in the memory. The system controller 13 generates a print job based on, for example, an image acquired from an external device via the communication interface 12. The system controller 13 stores the generated print job in the memory. The print job includes image data indicating an image formed on a print medium P. The image data may be data for forming an image on one piece of print medium P, or may be data for forming an image on a plurality of pieces of print media P. In addition, the print job contains information indicating a color print or a monochrome print.

Further, the system controller 13 functions as a controller that controls the operations of the transport unit 18, the image forming unit 19, and the fixer 20 by executing the program stored in the memory. That is, the system controller 13 controls the transport of the print medium P by the transport unit 18, controls the formation of an image on the print medium P by the image forming unit 19, and controls the fixing of the image on the print medium P by the fixer 20.

The display unit 14 includes a display that displays an image according to a video signal input from a display control unit such as a system controller 13 or a graphic controller (not illustrated). For example, the display of the display unit 14 displays information such as screens for various settings of the image forming apparatus 1 and the remaining amount of toner.

The operation interface 15 is connected to an operation member (not illustrated). The operation interface 15 supplies an operation signal corresponding to the operation of the operation member to the system controller 13. The operating member is, for example, a touch sensor, a numeric keypad, a power key, a paper feed key, various function keys, a keyboard, or the like. The touch sensor acquires information indicating a specified position within a certain area. The touch sensor is configured as a touch panel integrally with the display unit 14. The touch sensor inputs a signal indicating the touched position on the screen displayed on the display unit 14 to the system controller 13.

Each of the plurality of paper trays 16 is a cassette that houses the print medium P. The paper tray 16 can supply the print medium P from the outside of the housing 11. For example, the paper tray 16 can be pulled out from the housing 11.

The paper discharge tray 17 is a tray that supports the print medium P discharged from the image forming apparatus 1.

Next, a configuration for transporting the print medium P of the image forming apparatus 1 will be described.

The transport unit 18 is a mechanism for transporting the print medium P in the image forming apparatus 1. As illustrated in FIG. 1, the transport unit 18 includes a plurality of transport paths. For example, the transport unit 18 includes a paper feed transport path 31 and a paper discharge transport path 32.

The paper feed transport path 31 and the paper discharge transport path 32 each include a plurality of motors, a plurality of rollers, and a plurality of guides. The plurality of motors rotate a shaft under the control of the system controller 13 to rotate the rollers linked to the rotation of the shaft. The plurality of rollers move the print medium P by rotating. The plurality of guides control the transport direction of the print medium P.

The paper feed transport path 31 captures the print medium P from the paper tray 16 and supplies the captured print medium P to the image forming unit 19. The paper feed transport path 31 includes a pickup roller 33 corresponding to each paper tray. Each pickup roller 33 takes in the print medium P of the paper tray 16 into the paper feed transport path 31.

The paper discharge transport path 32 is a transport path for discharging the print medium P on which an image is formed from the housing 11. The print medium P discharged by the paper discharge transport path 32 is supported by the paper discharge tray 17.

Next, the image forming unit 19 will be described.

The image forming unit 19 is configured to form an image on the print medium P. Specifically, the image forming unit 19 forms an image on the print medium P based on the print job generated by the system controller 13.

The image forming unit 19 includes a plurality of loading units 41, a plurality of process units 42, a plurality of exposure devices 43, and a transfer mechanism 44. The image forming unit 19 includes the loading unit 41 and the exposure device 43 for each process unit 42. Since the plurality of process units 42, the plurality of loading units 41, and the plurality of exposure devices 43 have the same configuration, one process unit 42, one loading unit 41, and one exposure device 43 will be described as an example.

Figure 2:
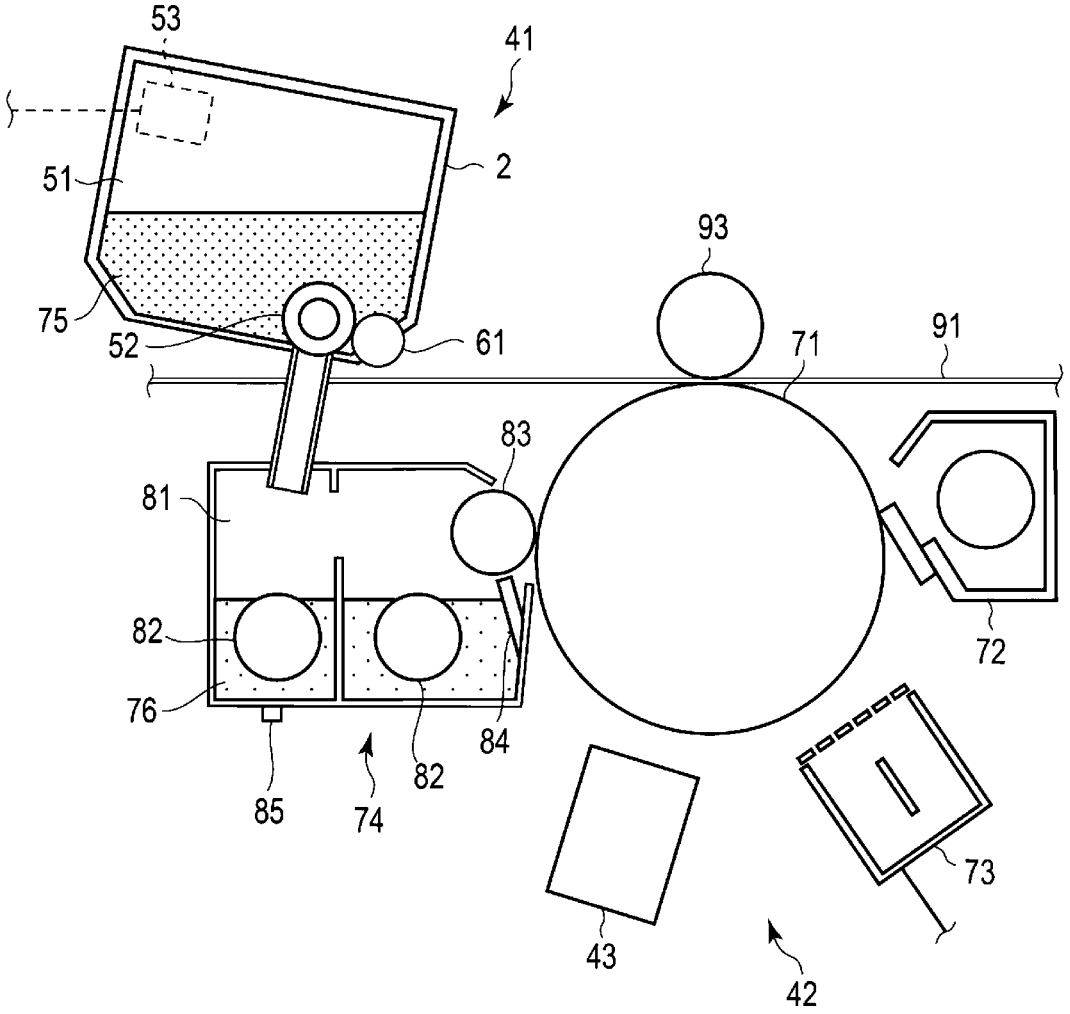
FIG. 2 is a view illustrating a configuration example of a part of the image forming unit.

FIG. 2 is an explanatory view illustrating an example of a partial configuration of the image forming unit 19.

First, the toner cartridge 2 mounted on the loading unit 41 will be described.

As illustrated in FIG. 2, the toner cartridge 2 includes a toner housing container 51 and a toner delivery mechanism 52.

The toner housing container 51 is a container for storing toner.

The toner delivery mechanism 52 is a mechanism for delivering the toner in the toner housing container 51. The toner delivery mechanism 52 is, for example, a screw provided in the toner housing container 51 and delivering toner by rotating.

Next, the loading unit 41 on which the toner cartridge 2 is mounted will be described.

As illustrated in FIG. 2, the loading unit 41 is a module in which the toner cartridge 2 filled with toner is mounted. The plurality of loading units 41 each include a space in which the toner cartridge 2 is mounted and a toner replenishment motor 61. Further, the plurality of loading units 41 each include a communication interface for connecting a memory 53 of the toner cartridge 2 and the system controller 13.

The toner replenishment motor 61 drives the toner delivery mechanism 52 of the toner cartridge 2 under the control of the system controller 13. If the toner cartridge 2 is loaded in the loading unit 41, the toner replenishment motor 61 is connected to the toner delivery mechanism 52 of the toner cartridge 2. Under the control of the system controller 13, the toner replenishment motor 61 rotates the shaft by being energized to drive the toner delivery mechanism 52 of the toner cartridge 2. The toner replenishment motor 61 drives the toner delivery mechanism 52 to supply the toner in the toner housing container 51 to a developing device 74 described later.

Next, the process unit 42 will be described.

The process unit 42 forms a toner image. For example, a plurality of process units 42 are provided for each type of toner. For example, the plurality of process units 42 correspond to color toners such as cyan, magenta, yellow, and black, respectively. Specifically, the toner cartridge 2 having toners of different colors is connected to each process unit 42.

As illustrated in FIG. 2, the process unit 42 includes a photoconductive drum 71, a cleaner 72, a charging charger 73, and the developing device 74.

The photoconductive drum 71 is a photoconductor including a cylindrical drum and a photoconductive layer formed on the outer peripheral surface of the drum. The photoconductive drum 71 rotates at a constant speed by a drive mechanism.

The cleaner 72 removes the toner remaining on the surface of the photoconductive drum 71.

The charging charger 73 uniformly charges the surface of the photoconductive drum 71. For example, the charging charger 73 charges the photoconductive drum 71 to a uniform negative electrode potential by applying a voltage to the photoconductive drum 71 by using a charging roller. The charging roller rotates by the rotation of the photoconductive drum 71 in a state where a predetermined pressure is applied to the photoconductive drum 71.

Figure 3:
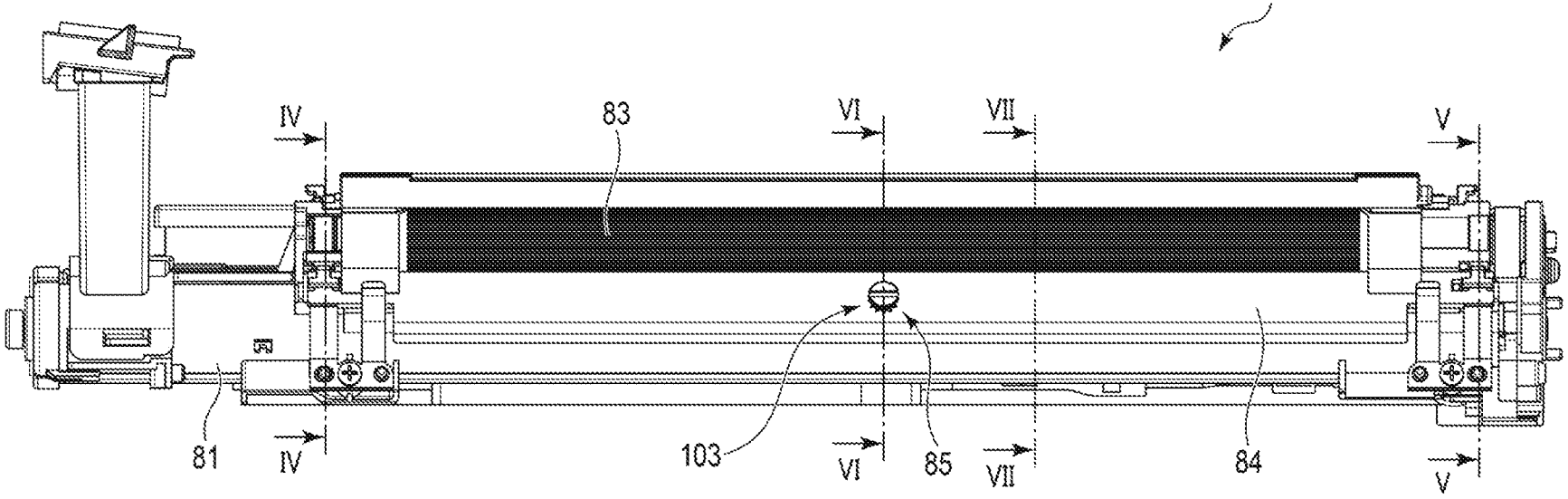
FIG. 3 is a view illustrating a developing device of an image forming unit of the image forming apparatus.
Figure 4:
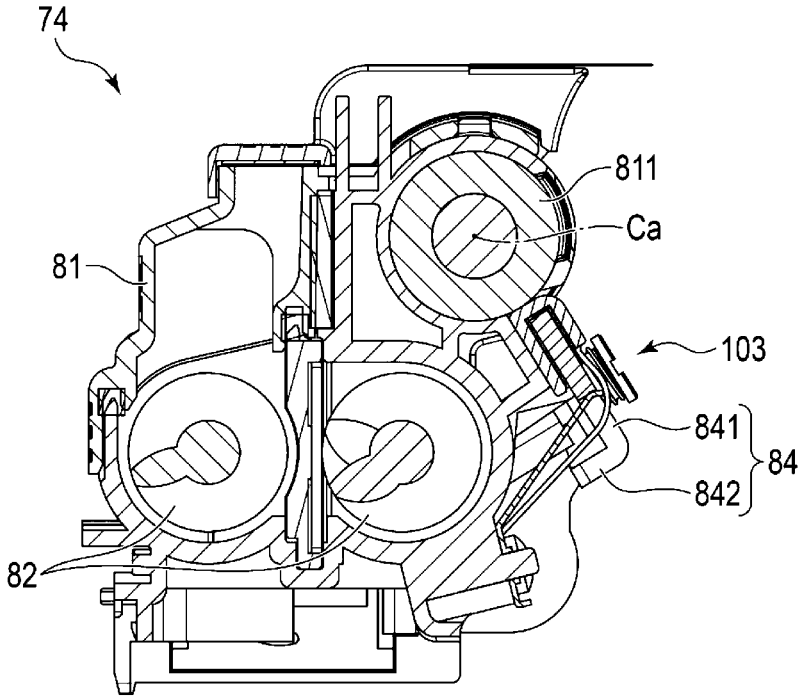
FIG. 4 is a cross-sectional view taken along the line IV-IV in FIG. 3.
Figure 5:
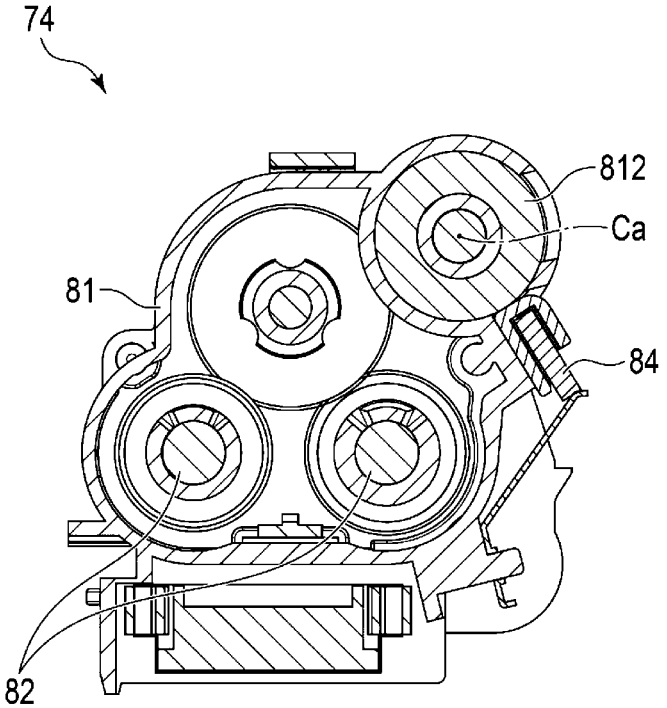
FIG. 5 is a cross-sectional view taken along the line V-V in FIG. 3.
Figure 6:
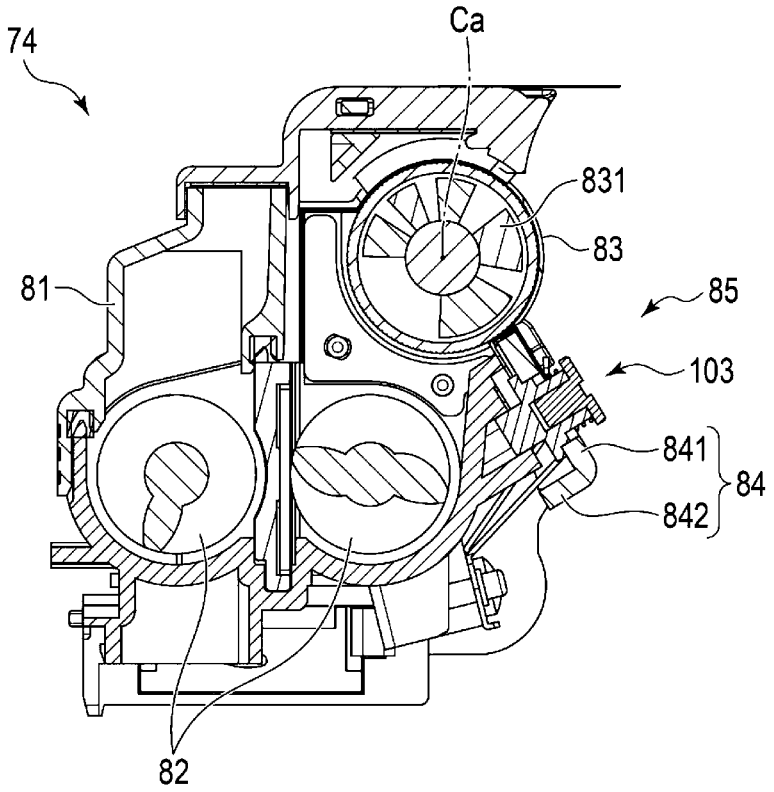
FIG. 6 is a cross-sectional view taken along the line VI-VI in FIG. 3.
Figure 7:
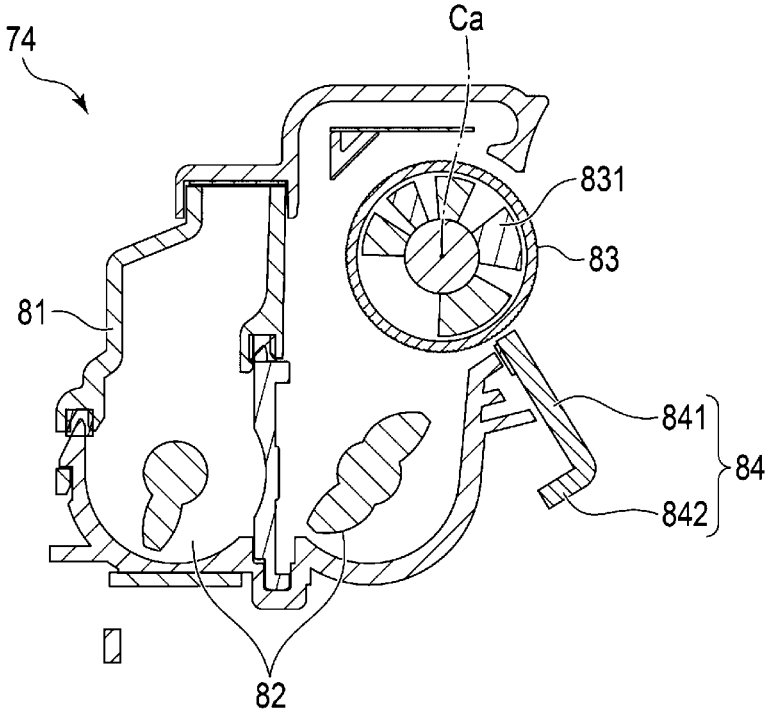
FIG. 7 is a cross-sectional view taken along the line VII-VII in FIG. 3.

FIG. 3 is a view illustrating the developing device 74 of the image forming unit 19. FIG. 4 is a cross-sectional view taken along the line IV-IV in FIG. 3. FIG. 5 is a cross-sectional view taken along the line V-V in FIG. 3. FIG. 6 is a cross-sectional view taken along the line VI-VI in FIG. 3. FIG. 7 is a cross-sectional view taken along the line VII-VII in FIG. 3.

The developing device 74 illustrated in FIGS. 2 to 7 is a device for toner adhering to the photoconductive drum 71. The developing device 74 includes a developing case 81, a stirring portion 82, a developing sleeve (magnet roller) 83, and a doctor blade 84.

The developing case 81 receives the toner 75 delivered from the toner cartridge 2 by the toner delivery mechanism 52. A carrier is housed in the developing case 81 during the manufacture of the developing device 74. Therefore, the developing case 81 houses a developer 76 containing the toner 75 and the carrier that is stirred with the toner 75.

The stirring portion 82 is provided in the developing case 81. The stirring portion 82 is driven by a motor (not illustrated). The toner 75 in the developing case 81 and the carrier are stirred. That is, the stirring portion 82 stirs the developer 76.

The developing sleeve 83 has a cylindrical shape, and central axes Ca at both ends of the cylinder are supported by the developing case 81. The developing sleeve 83 rotates with respect to the developing case 81 by a bearing 811 at one end and a bearing 812 at the other end of the developing case 81. The length of the outer surface of the developing sleeve 83 in the longitudinal direction is longer than, for example, the length in the lateral direction of A4 paper. The developing sleeve 83 attracts the developer to the outer surface of the developing sleeve 83 by utilizing the magnetic force of a magnet 831 disposed inside the developing sleeve 83. Therefore, if the developing sleeve 83 rotates with respect to the developing case 81, the developer adheres to the outer peripheral surface of the developing sleeve 83.

The doctor blade 84 is disposed at a predetermined distance from the outer surface of the developing sleeve 83. The longitudinal length of the doctor blade 84 is longer than, for example, the lateral length of A4 paper. The longitudinal length of the doctor blade 84 is equal to or longer than the longitudinal length of the outer surface of the developing sleeve 83.

Both ends of the doctor blade 84 are fixed to the developing case 81. The doctor blade 84 includes a substantially rectangular plate-shaped blade portion 841 that is long in the longitudinal direction, and a rib 842 that is integrated with one end portion of a pair of longitudinal end portions of the blade portion 841. The surface of the rib 842 is bent approximately 90 degrees with respect to the surface of the blade portion 841. Therefore, the rib 842 suppresses the bending of the blade portion 841. The other end portion of the blade portion 841 has straightness with a predetermined gap from the outer surface of the developing sleeve 83.

The other end portion of the blade portion 841 of the doctor blade 84 in the longitudinal direction removes a part of the developer adhering to the outer surface of the rotating developing sleeve 83. As a result, the doctor blade 84 forms a layer of the developer having a thickness corresponding to the distance between the doctor blade 84 and the outer surface of the developing sleeve 83 on the outer surface of the developing sleeve 83.

The length of the blade portion 841 of the doctor blade 84 in the lateral direction is, for example, about 14 mm. The total length of the blade portion 841 in the lateral direction and the thickness of the rib 842 are, for example, about 16 mm.

Next, the exposure device 43 illustrated in FIG. 2 will be described.

The exposure device 43 includes a plurality of light emitting elements. The exposure device 43 forms a latent image on the photoconductive drum 71 by irradiating the charged photoconductive drum 71 with light from the light emitting element. The light emitting element is, for example, a light emitting diode (LED) or a laser diode (LD). One light emitting element irradiates one point on the photoconductive drum 71 with light. A plurality of light emitting elements are arranged in the main scanning direction, which is a direction parallel to the rotation shaft of the photoconductive drum 71.

The exposure device 43 forms a latent image for one line on the photoconductive drum 71 by irradiating the photoconductive drum 71 with light by the plurality of light emitting elements arranged in the main scanning direction. Further, the exposure device 43 forms a latent image for a plurality of lines by continuously irradiating the rotating photoconductive drum 71 with light.

In the above configuration, if the surface of the photoconductive drum 71 charged by the charging charger 73 is irradiated with light from the exposure device 43, an electrostatic latent image is formed on the surface of the photoconductive drum 71. If the layer of the developer formed on the surface of the developing sleeve 83 is close to the surface of the photoconductive drum 71, the toner contained in the developer adheres to the latent image formed on the surface of the photoconductive drum 71. As a result, a toner image is formed on the surface of the photoconductive drum 71.

Next, the transfer mechanism 44 illustrated in FIG. 1 will be described.

The transfer mechanism 44 has a configuration in which the toner image formed on the surface of the photoconductive drum 71 is transferred to the printing medium P.

As illustrated in FIGS. 1 and 2, the transfer mechanism 44 includes, for example, a primary transfer belt 91, a secondary transfer opposing roller 92, a plurality of primary transfer rollers 93, and a secondary transfer roller 94.

The primary transfer belt 91 is an endless belt wound around the secondary transfer opposing roller 92 and a plurality of winding rollers. In the primary transfer belt 91, the inner surface (inner peripheral surface) is in contact with the secondary transfer opposing roller 92 and the plurality of winding rollers, and the outer surface (outer peripheral surface) is opposed to the photoconductive drum 71 of the process unit 42.

The secondary transfer opposing roller 92 rotates by a motor (not illustrated). The secondary transfer opposing roller 92 rotates to transport the primary transfer belt 91 in a predetermined transport direction. The plurality of winding rollers can rotate freely. The plurality of winding rollers rotate according to the movement of the primary transfer belt 91 by the secondary transfer opposing roller 92.

The plurality of primary transfer rollers 93 bring the primary transfer belt 91 into contact with the photoconductive drum 71 of the process unit 42. The plurality of primary transfer rollers 93 correspond to the photoconductive drums 71 of the plurality of process units 42, respectively. Specifically, the plurality of primary transfer rollers 93 are provided at positions facing each other with the photoconductive drum 71 of the corresponding process unit 42 and the primary transfer belt 91 interposed therebetween. The primary transfer roller 93 comes into contact with the inner peripheral surface side of the primary transfer belt 91 and displaces the primary transfer belt 91 toward the photoconductive drum 71. As a result, the primary transfer roller 93 brings the outer peripheral surface of the primary transfer belt 91 into contact with the photoconductive drum 71.

The secondary transfer roller 94 is provided at a position facing the primary transfer belt 91. The secondary transfer roller 94 comes in contact with the outer peripheral surface of the primary transfer belt 91 and applies pressure. As a result, a transfer nip is formed in which the secondary transfer roller 94 and the outer peripheral surface of the primary transfer belt 91 are in close contact with each other. If the print medium P passes through the transfer nip, the secondary transfer roller 94 presses the print medium P passing through the transfer nip against the outer peripheral surface of the primary transfer belt 91.

The secondary transfer roller 94 and the secondary transfer opposing roller 92 rotate to transport the print medium P supplied from the paper feed transport path 31 in a state of sandwiching the print medium P. As a result, the print medium P passes through the transfer nip.

In the above configuration, if the outer peripheral surface of the primary transfer belt 91 comes into contact with the photoconductive drum 71, the toner image formed on the surface of the photoconductive drum is transferred to the outer peripheral surface of the primary transfer belt 91. As illustrated in FIG. 1, if the image forming unit 19 includes the plurality of process units 42, the primary transfer belt 91 receives the toner image from the photoconductive drums 71 of the plurality of process units 42. The toner image transferred to the outer peripheral surface of the primary transfer belt 91 is transported by the primary transfer belt 91 to the transfer nip in which the secondary transfer roller 94 and the outer peripheral surface of the primary transfer belt 91 are in close contact with each other. If the print medium P is present in the transfer nip, the toner image transferred to the outer peripheral surface of the primary transfer belt 91 is transferred to the print medium P in the transfer nip.

Next, a configuration related to fixing of the image forming apparatus 1 will be described.

The fixer 20 melts the toner transferred to the print medium P and fixes the toner image. The fixer 20 operates under the control of the system controller 13. The fixer 20 includes a heating member that applies heat to the print medium P and a pressurizing member that applies pressure to the print medium P. For example, the heating member is, for example, a heat roller 95. Further, for example, the pressurizing member is a press roller 96.

The heat roller 95 is a fixing rotating body that is rotated by a motor (not illustrated). The heat roller 95 has a core metal formed of hollow metal and an elastic layer formed on the outer periphery of the core metal. The heat roller 95 is heated to a high temperature by a heater disposed inside the core metal formed in a hollow shape. The heater is, for example, a halogen heater. Further, the heater may be an induction heating (IH) heater that heats the core metal by electromagnetic induction.

The press roller 96 is provided at a position facing the heat roller 95. The press roller 96 has a core metal formed of metal having a predetermined outer diameter, and an elastic layer formed on the outer periphery of the core metal. The press roller 96 applies pressure to the heat roller 95 by a stress applied from a tension member (not illustrated). If pressure is applied from the press roller 96 to the heat roller 95, a nip (fixing nip) in which the press roller 96 and the heat roller 95 are in close contact with each other is formed. The press roller 96 is rotated by a motor (not illustrated). The press roller 96 rotates to move the print medium P that enters the fixing nip, and presses the print medium P against the heat roller 95.

With the above configuration, the heat roller 95 and the press roller 96 apply heat and pressure to the print medium P passing through the fixing nip. As a result, the toner image is fixed on the print medium P that passes through the fixing nip. The print medium P that passes through the fixing nip is introduced into the paper discharge transport path 32 and discharged to the outside of the housing 11.

As illustrated in FIGS. 3 and 6, in the present embodiment, the developing device 74 of the process unit 42 further includes an adjusting mechanism 85 that adjusts the distance (gap) between the doctor blade 84 and the outer surface of the developing sleeve 83.

Figure 8:
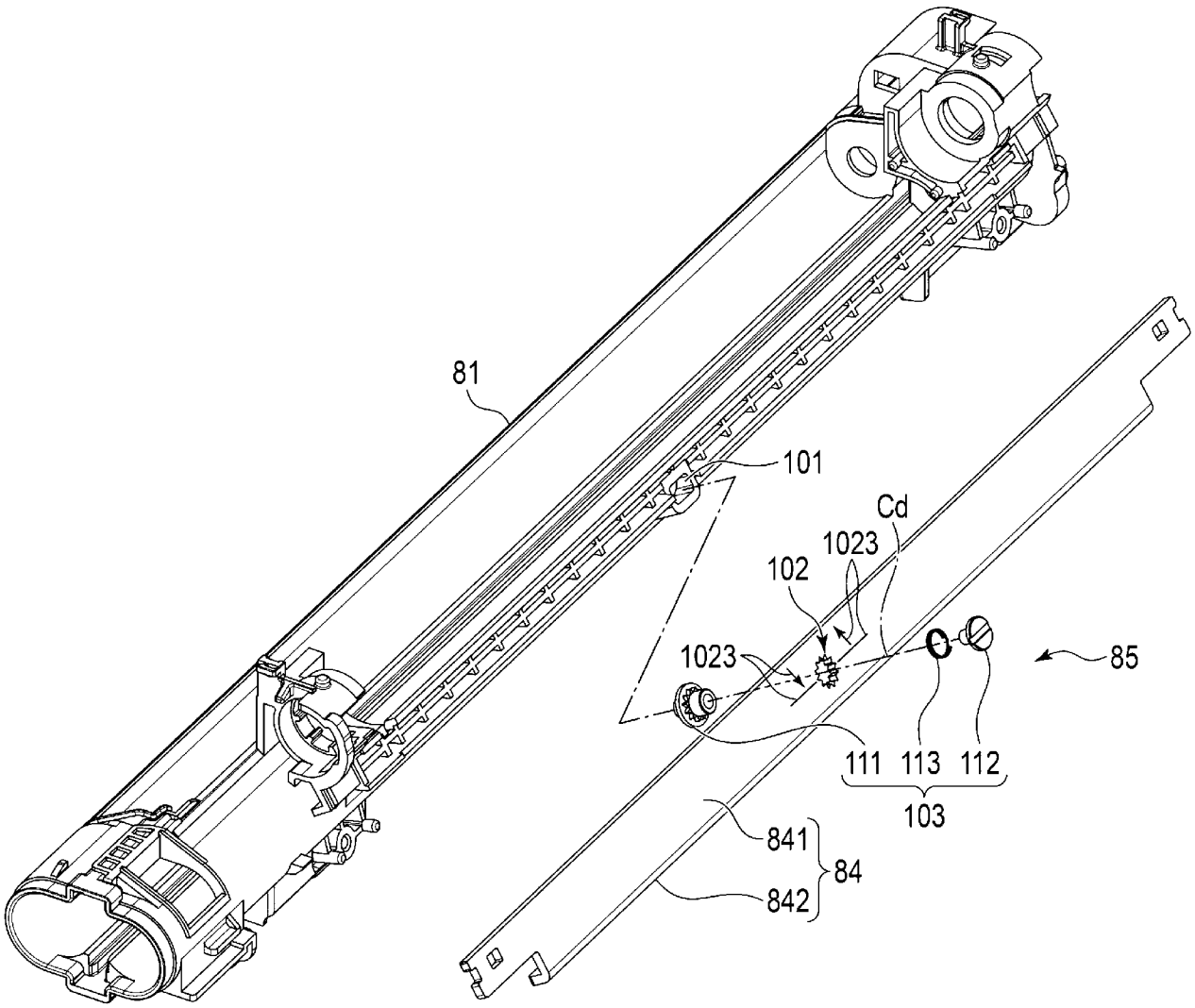
FIG. 8 is an exploded perspective view illustrating a developing case, a doctor blade, and an adjusting mechanism.

FIG. 8 is an exploded perspective view illustrating the developing case 81, the doctor blade 84, and the adjusting mechanism 85. In FIG. 8, the bearings 811 and 812, the stirring portion 82, and the developing sleeve 83 are not illustrated from the developing case 81. FIG. 8 illustrates an exploded perspective view of an adjusting portion 103.

The adjusting mechanism 85 is provided on the developing case 81 and the doctor blade 84. The adjusting mechanism 85 includes a concave hole 101 provided in the developing case 81, a through hole 102 provided in the doctor blade 84, and the adjusting portion 103.

Figure 9:
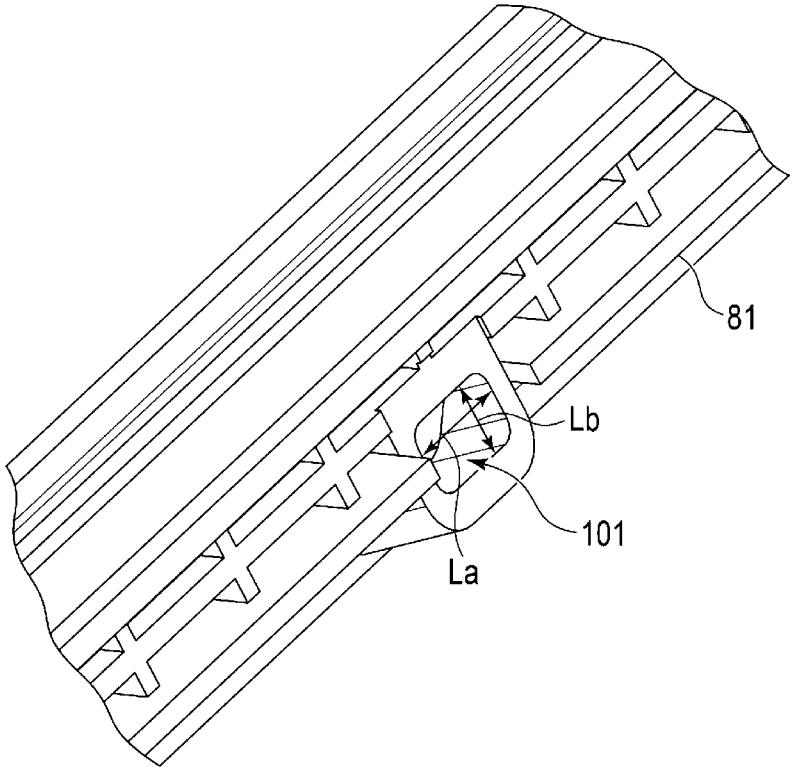
FIG. 9 illustrates an enlarged view of a concave hole provided in the developing case.
Figure 10:
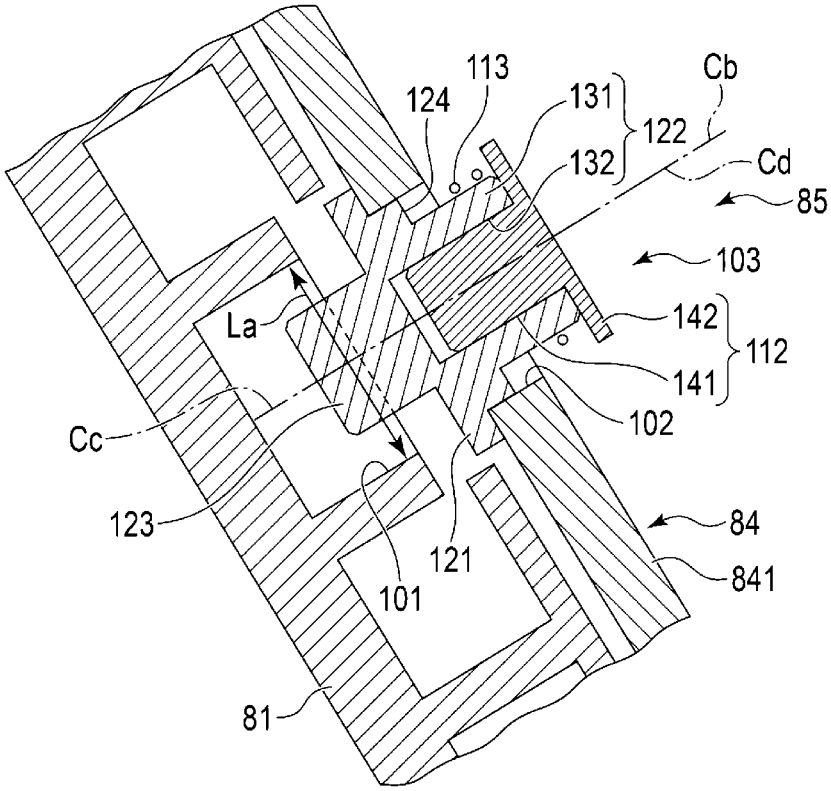
FIG. 10 is a cross-sectional view of a developing case, a doctor blade, and an adjusting portion, along a longitudinal axis of the adjusting portion and along a longitudinal axis of the developing case and the doctor blade.
Figure 11:
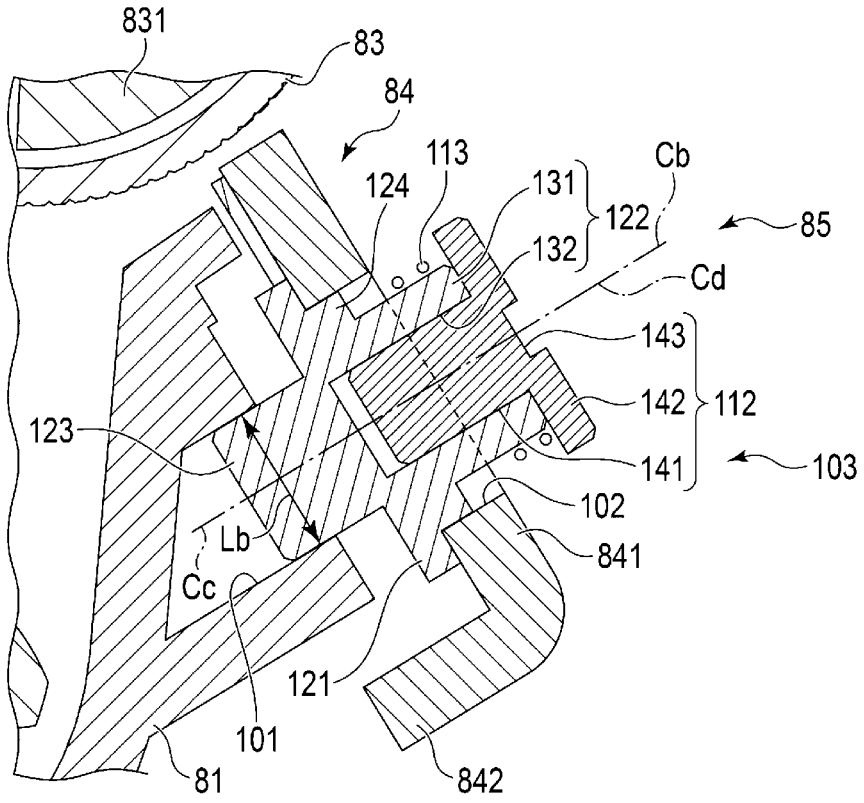
FIG. 11 is a cross-sectional view taken along an axis orthogonal to the longitudinal axis of the developing case, the doctor blade, and the adjusting portion, along the longitudinal axis of the adjusting portion and along a direction orthogonal to the longitudinal axis of the developing case and the doctor blade.

FIG. 9 illustrates an enlarged view of the concave hole 101 provided in the developing case 81. FIG. 10 illustrates a cross section of the developing case 81, the doctor blade 84, and the adjusting portion 103 along the longitudinal axis of the adjusting portion 103 and along the longitudinal axis of the developing case 81 and the doctor blade 84. FIG. 11 is a cross-sectional view taken along an axis orthogonal to the longitudinal axis of the developing case 81, the doctor blade 84, and the adjusting portion 103, along the longitudinal axis of the adjusting portion 103 and along a direction orthogonal to the longitudinal axis of the developing case 81 and the doctor blade 84.

As illustrated in FIGS. 8 and 9, the concave hole 101 of the developing case 81 is formed substantially at the center of both ends of the developing case 81 which is long in the longitudinal direction. As illustrated in FIGS. 8 to 11, the concave hole 101 has a substantially rectangular opening sized to fit the outer edge of a cam 123, which will be described later, of the adjusting portion 103. The opening of the concave hole 101 is formed in a substantially rectangular shape long in the longitudinal direction of the doctor blade 84. The opening of the concave hole 101 has a short side that accepts the outer edge of the cam 123 and a long side that is longer than the short side. The long side is parallel to the longitudinal direction of the developing case 81. The short sides intersect in the longitudinal direction of the developing case 81. The short sides are, for example, orthogonal to the longitudinal direction of the developing case 81. A length Lb of the concave hole 101 in the lateral direction is the length to which the outer edge of the cam 123 fits. Therefore, the length Lb=a+g=b+f=c+e=d+d (see FIGS. 19 to 22). A longitudinal length La of the concave hole 101 is longer than the length to which the outer edge of the cam 123 fits. The concave hole 101 has a shape in which the cam 123 is further inserted into the concave hole 101 along a central axis Cb of a rotating portion 122 of an adjusting stud 111 and a predetermined axis Cc of the cam 123 from the state where the cam 123 is in a predetermined position. Therefore, the concave hole 101 has a shape that allows the cam 123 to move in a predetermined range along the predetermined axis Cc.

As illustrated in FIG. 3, the through hole 102 of the doctor blade 84 is formed at substantially the center of both end portions of the doctor blade 84 in the longitudinal direction. Therefore, the doctor blade 84 includes the through hole 102 in the central portion in the longitudinal direction.

Figure 12:
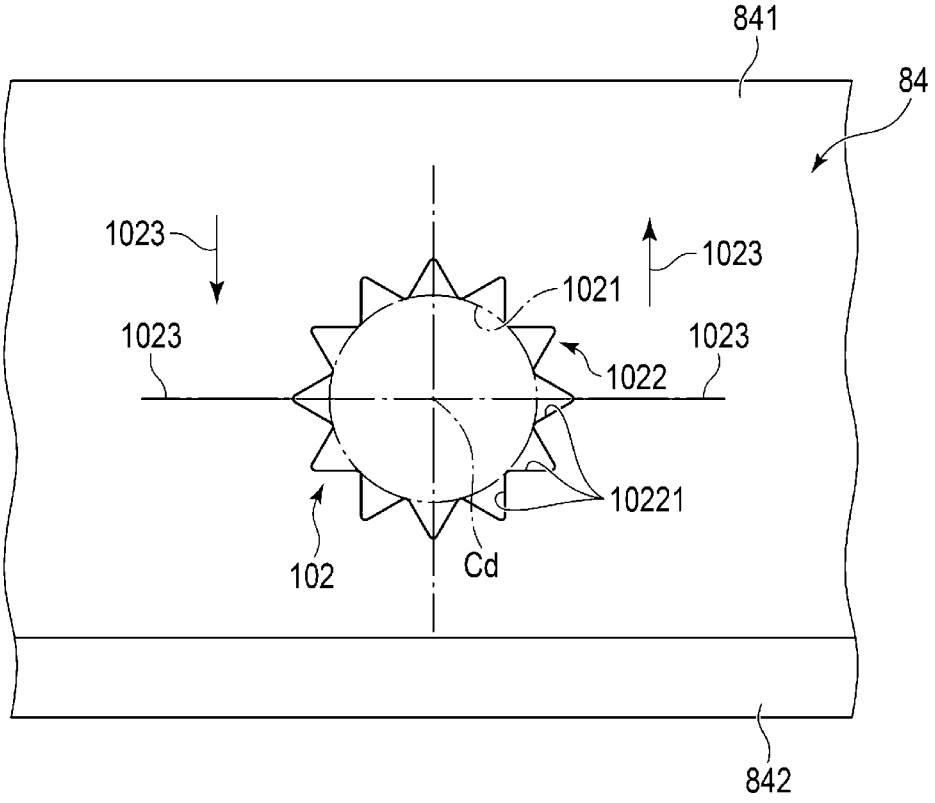
FIG. 12 illustrates an enlarged view of a through hole provided in the doctor blade.
Figure 13:
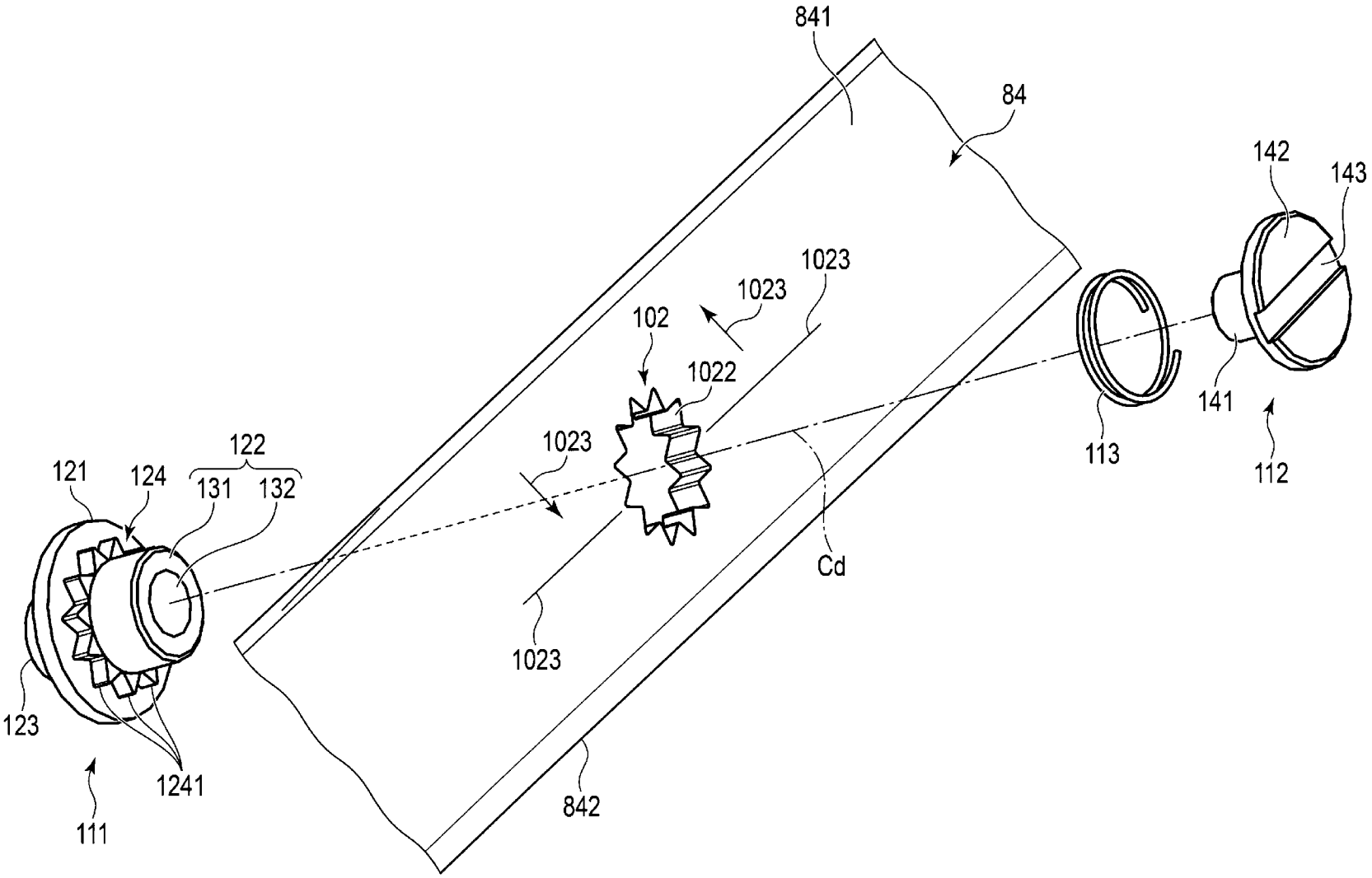
FIG. 13 illustrates an exploded perspective view of the through hole of the doctor blade and the adjusting portion.

FIG. 12 illustrates an enlarged view of the through hole 102 provided in the doctor blade 84. FIG. 13 illustrates an exploded perspective view of the through hole 102 of the doctor blade 84 and the adjusting portion. As illustrated in FIGS. 12 and 13, the through hole 102 includes a circular hole 1021 illustrated by an imaginary line and a first engaging portion 1022 that surrounds the outside of the circular hole 1021.

The innermost circumference of the first engaging portion 1022, that is, the circular hole 1021 has a size in which a tubular body 131 of the rotating portion 122 of the adjusting portion 103 is inserted, the outer edge of the tubular body 131 fits, and the tubular body 131 rotates. The innermost circumference of the first engaging portion 1022, that is, the circular hole 1021, has a size that a base portion 121 of the adjusting portion 103 does not pass through.

The first engaging portion 1022 has a plurality of irregularities along the circumferential direction. The first engaging portion 1022 is rotationally symmetric with respect to, for example, a central axis Cd of the through hole 102. The first engaging portion 1022 includes, for example, a spline-shaped portion. The first engaging portion 1022 includes three concave portions 10221, for example, every 90 degrees. That is, the first engaging portion 1022 includes, for example, 12 concave portions 10221. The adjacent concave portions 10221 are offset by 30° with respect to the central axis Cd. The shape and size of each concave portion 10221 are the same. A second engaging portion (spline-shaped portion) 124 of the adjusting portion 103, which will be described later, can be engaged with and disengaged from the first engaging portion 1022.

The adjusting portion 103 adjusts the distance between the doctor blade 84 and the outer surface of the developing sleeve 83 by adjusting the position of the doctor blade 84 with respect to the developing case 81.

As illustrated in FIG. 8, the adjusting portion 103 includes the adjusting stud 111, an adjusting screw (rotating body) 112, and an adjusting spring (urging body) 113.

Figure 14:
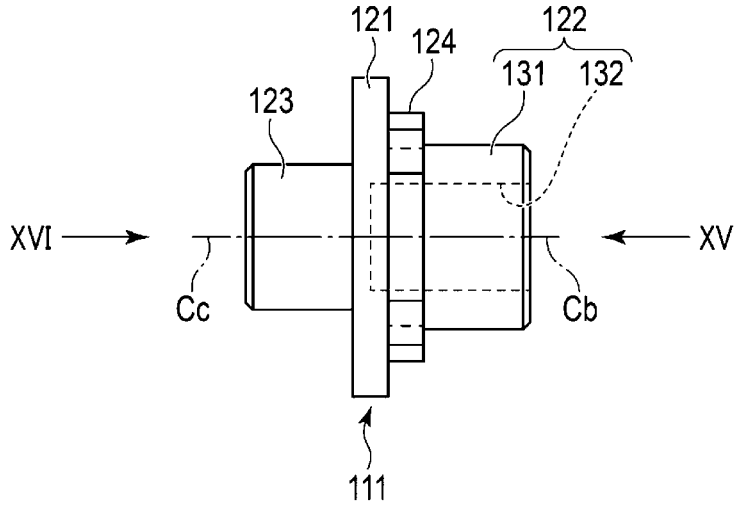
FIG. 14 illustrates a front view of an adjusting stud of the adjusting portion.
Figure 15:
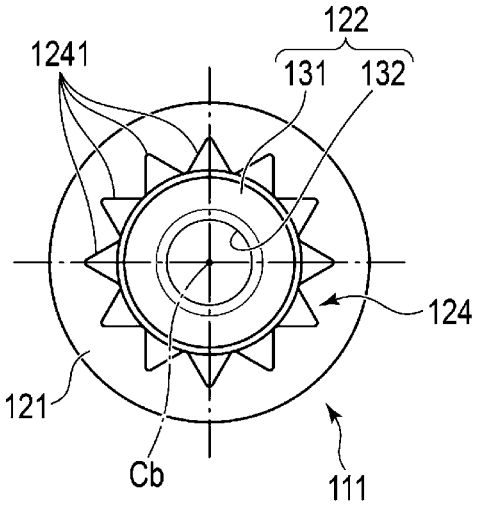
FIG. 15 illustrates the adjusting stud in FIG. 14 seen from a direction of an arrow XV.
Figure 16:
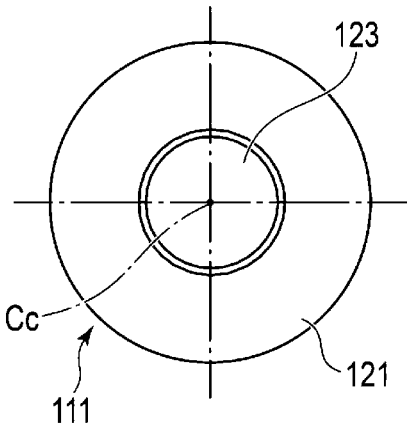
FIG. 16 illustrates the adjusting stud in FIG. 14 seen from a direction of an arrow XVI.
Figure 17:
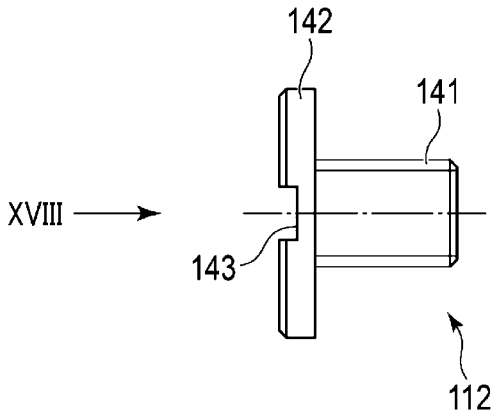
FIG. 17 illustrates a front view of an adjusting screw of the adjusting portion.
Figure 18:
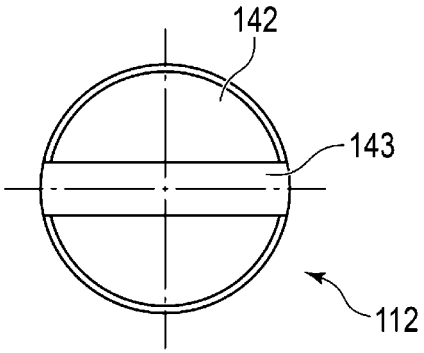
FIG. 18 illustrates the adjusting screw in FIG. 17 seen from a direction of an arrow XVIII.

FIG. 14 is a front view of the adjusting stud 111 of the adjusting portion 103, FIG. 15 is a view of the adjusting stud 111 in FIG. 14 seen from the direction of an arrow XV, and FIG. 16 is a view of the adjusting stud 111 in FIG. 14 seen from the direction of an arrow XVI. FIG. 17 is a front view of the adjusting screw 112 of the adjusting portion 103, and FIG. 18 is a view of the adjusting screw in FIG. 17 seen from the direction of an arrow XVIII.

The adjusting stud 111 includes the base portion 121, the shaft-shaped rotating portion 122, and the cam 123. The adjusting stud 111 further includes the second engaging portion (spline-shaped portion) 124. The base portion 121, the rotating portion 122, the cam 123, and the second engaging portion 124 are integrated.

The base portion 121 is a plate-like body disposed between the doctor blade 84 and the concave hole 101 of the developing case 81. The base portion 121 is formed so as not to pass through the through hole 102. The base portion 121 is brought into contact with and detached from the doctor blade 84.

The rotating portion 122 projects to the opposite side of the developing case 81 through the through hole 102 of the doctor blade 84. The rotating portion 122 includes the tubular body 131 and a female screw portion 132.

The tubular body 131 is cylindrical and passes through the through hole 102 of the doctor blade 84. Therefore, the rotating portion 122 penetrates through the through hole 102. The outer peripheral surface of the tubular body 131 of the rotating portion 122 has a size that allows the tubular body 131 to rotate with respect to the innermost circumference of the first engaging portion 1022 of the through hole 102. The female screw portion 132 is formed on the inner peripheral surface of the rotating portion 122 on the side opposite to the base portion 121.

The adjusting screw 112 includes a male screw portion 141, a flange-shaped flange portion (head portion) 142 of the male screw portion 141, and a sliding groove 143 of the flange portion 142. The male screw portion 141 is screwed into the female screw portion 132 and fixed to the adjusting stud 111. The flange portion 142 of the adjusting screw 112 is rotated by a tool such as a flat-blade screwdriver fitting into the sliding groove 143. The flange portion 142 projects radially outward with respect to the outer peripheral surface of the tubular body 131. The adjusting screw 112 is fixed to the adjusting stud 111 with the adjusting spring 113 supported between the adjusting screw 112 and the adjusting stud 111. Therefore, the adjusting screw 112 is a fixed body fixed to the adjusting stud 111.

The cam 123 is substantially columnar. The cam 123 projects from the base portion 121 toward the developing case 81 and fits into the concave hole 101.

Figure 19:
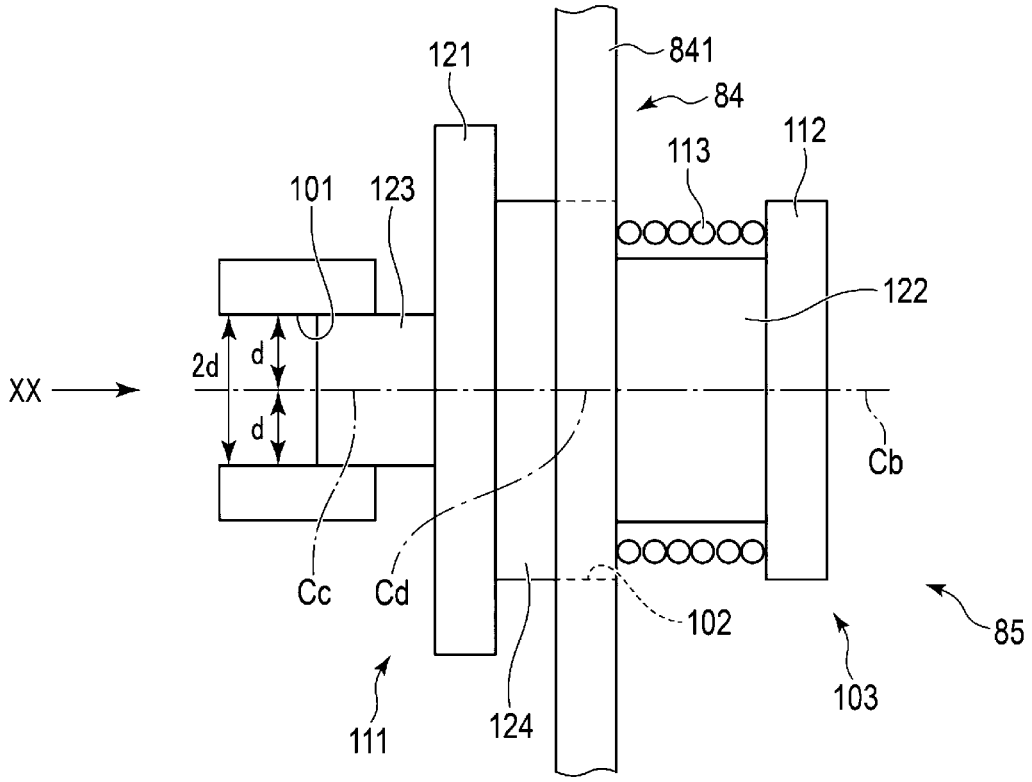
FIG. 19 illustrates the concave hole of the developing case, the adjusting stud, and the doctor blade.

FIG. 19 illustrates the concave hole 101 of the developing case 81, the adjusting stud 111, and the doctor blade 84. FIG.

20 is a view of the cam 123 of the adjusting stud 111 seen from the direction indicated by the arrow XX in FIG. 19.

Figure 20:
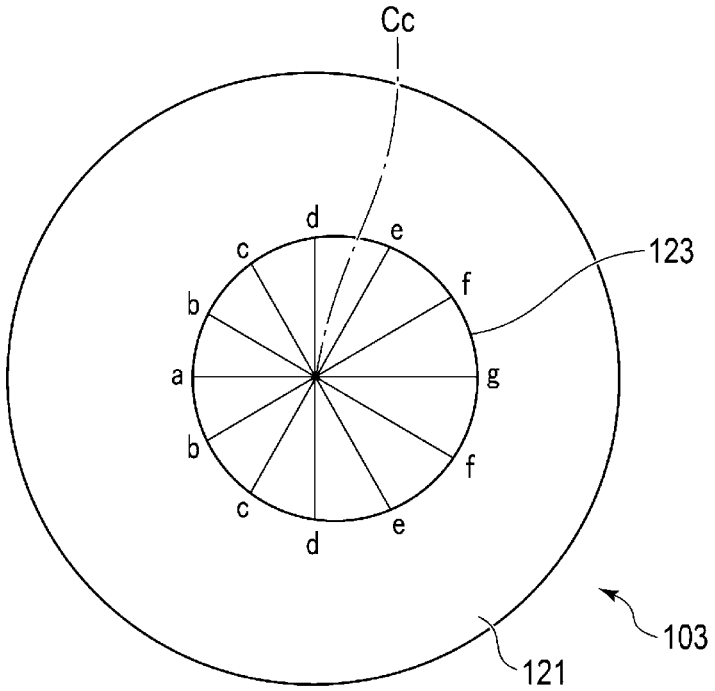
FIG. 20 is a view of an adjusting stud cam seen from a direction indicated by an arrow XX in FIG. 19.
Figure 21:
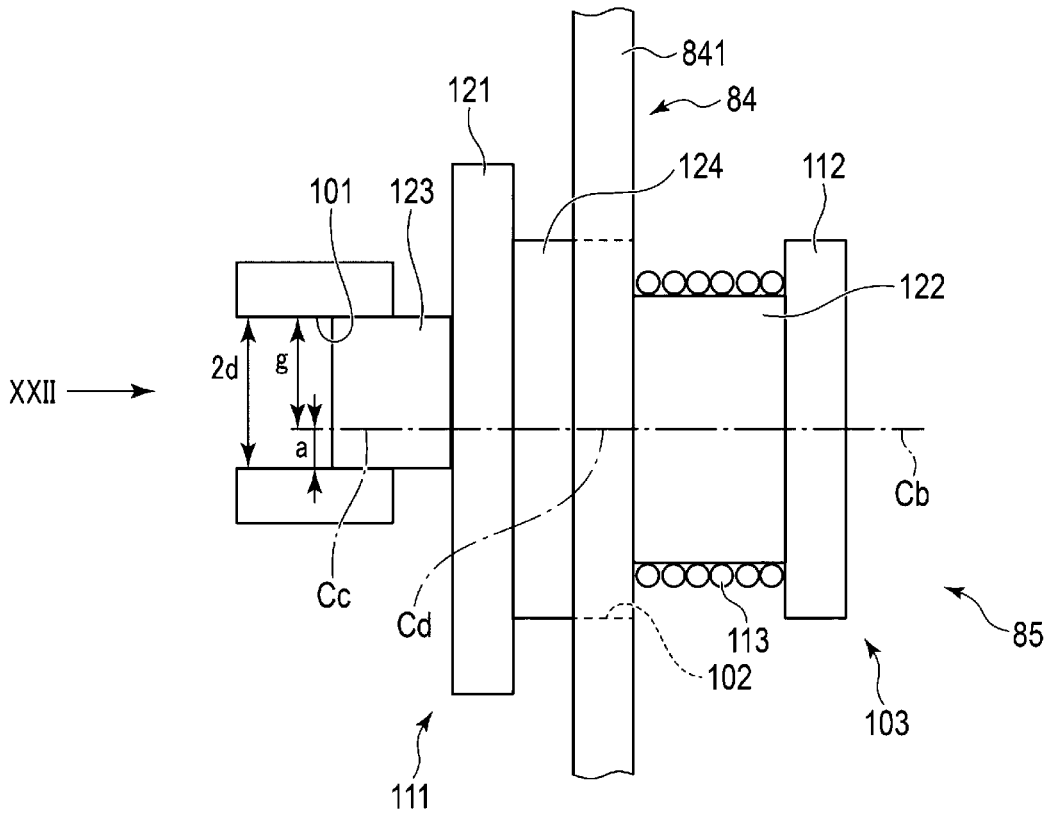
FIG. 21 illustrates a concave hole of the developing case, the adjusting stud, and the doctor blade in a state where the adjusting stud is rotated by 90° from a position (initial position) illustrated in FIG. 19.
Figure 22:
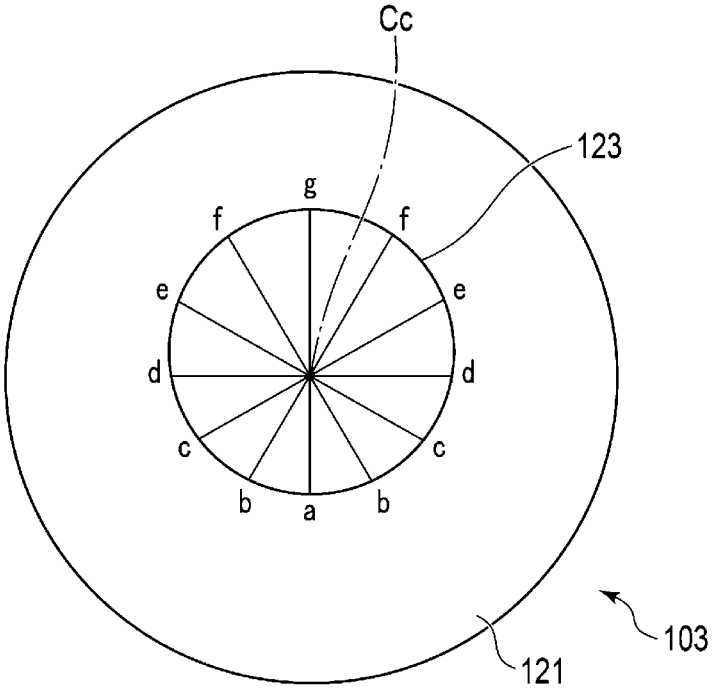
FIG. 22 is a view of the adjusting stud cam seen from the direction indicated by an arrow XXII in FIG. 21.

In FIG. 21, the concave hole 101 of the developing case 81, the adjusting stud 111, and the doctor blade 84 in a state where the adjusting stud 111 is rotated 90° from the positions (initial positions) illustrated in FIGS. 19 and 20 are illustrated. FIG. 22 is a view of the cam 123 of the adjusting stud 111 seen from the direction indicated by an arrow XXII in FIG. 21.

As illustrated in FIGS. 20 and 22, the outer edge of the cam 123 is a collection of ends of a plurality of line segments having a predetermined length passing through the predetermined axis Cc common to the central axis Cb of the rotating portion 122. Each line segment is orthogonal to the central axis Cb and the predetermined axis Cc. Therefore, the outer edge of the cam 123 is formed by the ends of line segments having the same length passing through the predetermined axis Cc.

In the cam 123 according to the present embodiment, $a+g=b+f=c+e=d+d$ holds. Here, a, b, c, d, e, f, and g are the distances from the predetermined axis Cc to the outer edge of the cam 123, respectively, and $a<b<c<d<e<f<g$. Therefore, in a first line segment among the plurality of line segments, a length d between the predetermined axis Cc and a first end and the length d between the predetermined axis Cc and a second end are the same. In a second line segment, which is different from the first line segment among the plurality of line segments, the length between the predetermined axis Cc and a third end (for example, length a) and the length between the predetermined axis Cc and a fourth end (for example, length g) are different. The adjacent line segments a, b, c, d, e, f, and g are offset by 30° with respect to the predetermined axis Cc.

As illustrated in FIGS. 14 and 15, the second engaging portion 124 is formed on the side opposite to the cam 123 with respect to the base portion 121. The second engaging portion 124 is provided between the rotating portion 122 and the base portion 121. The second engaging portion 124 is formed so as to be engageable with the first engaging portion 1022 at the edge of the through hole 102. The second engaging portion 124 has a plurality of irregularities along the circumferential direction. The second engaging portion 124 includes three convex portions 1241 every 90 degrees. That is, the second engaging portion 124 includes, for example, 12 convex portions 1241. The adjacent convex portion 1241 is displaced by 30° with respect to the central axis Cb. The shape and size of each convex portion 1241 are the same. The first engaging portion (spline-shaped portion) 1022 can be engaged with and disengaged from the second engaging portion 124. Therefore, the adjusting portion 103 fits into the through hole 102 of the doctor blade 84.

The adjusting spring 113 is a compression coil spring disposed on the outer circumference of the rotating portion 122. One end of the adjusting spring 113 is supported by the adjusting screw 112. The other end of the adjusting spring 113 is supported by the first engaging portion 1022 of the through hole 102 of the doctor blade 84. Therefore, the adjusting screw 112 is separated from the doctor blade 84 by the adjusting spring 113. Then, the adjusting screw 112 maintains a state where the first engaging portion 1022 and the second engaging portion 124 are engaged with each other by the adjusting spring 113. At this time, the base portion 121 is supported on the surface of the doctor blade 84 on the side opposite to the side that supports the other end of the adjusting spring 113.

As illustrated in FIGS. 12 and 13, the rotating portion 122 and the doctor blade 84 include an index portion indicating an adjusting amount with respect to an initial gap between the doctor blade 84 and the outer surface of the developing sleeve 83. The index portion of the rotating portion 122 is, for example, the sliding groove 143. The doctor blade 84 includes an index portion 1023 indicating an amount of adjustment with respect to the initial gap between the doctor blade 84 and the outer surface of the developing sleeve 83. The index portion 1023 of the doctor blade 84 is provided around the through hole 102 of the blade portion 841 of the doctor blade 84. The index portion 1023 of the doctor blade 84 indicates whether the doctor blade 84 approaches or moves away from the outer surface of the developing sleeve 83 according to the rotation direction of the rotating portion 122. For example, the index portion 1023 indicates that the doctor blade 84 approaches the outer surface of the developing sleeve 83 if the rotating portion 122 is rotated clockwise with respect to the through hole 102 of the doctor blade 84. The index portion 1023 indicates that the doctor blade 84 moves away from the outer surface of the developing sleeve 83 if the rotating portion 122 is rotated counterclockwise with respect to the through hole 102 of the doctor blade 84.

The work of adjusting the distance (gap) between the doctor blade 84 and the outer surface of the developing sleeve 83 will be described by using the adjusting portion 103 of the adjusting mechanism 85.

Figure 23:
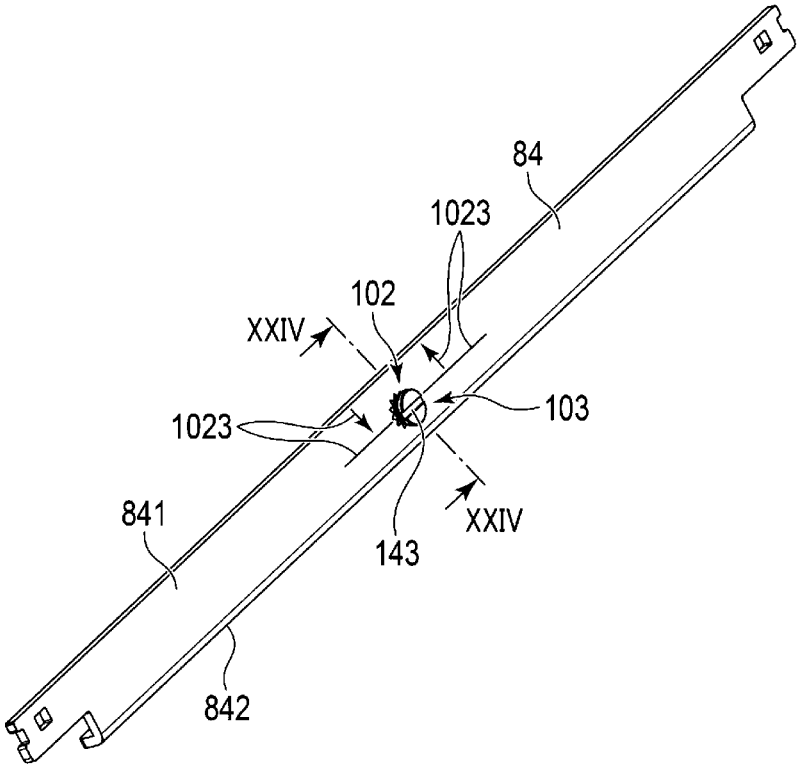
FIG. 23 is a schematic perspective view illustrating a positional relationship between the doctor blade and a sliding groove of the adjusting screw of the adjusting portion.
Figure 24:
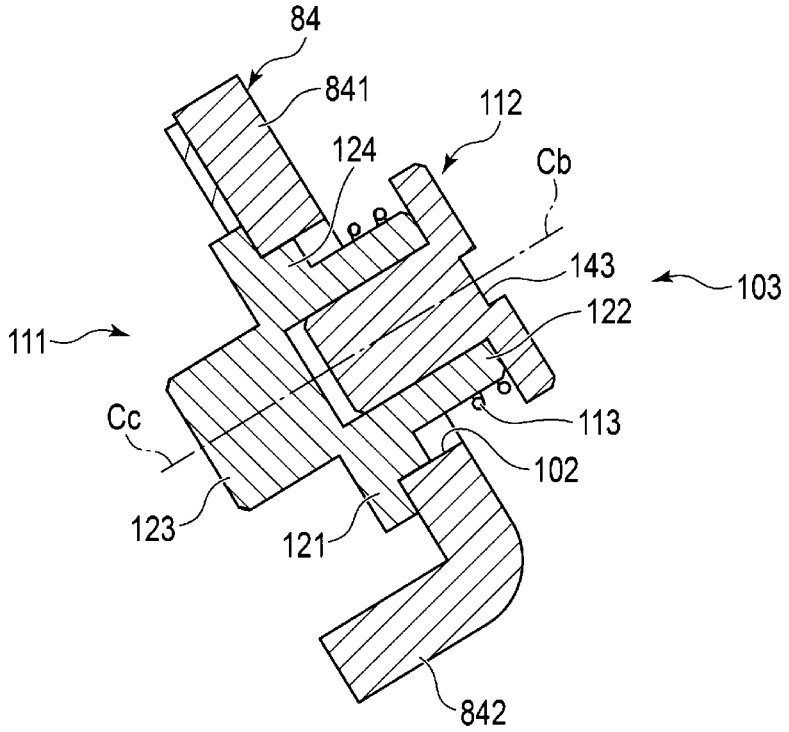
FIG. 24 is a cross-sectional view taken along the line XXIV-XXIV in FIG. 23.
Figure 25:
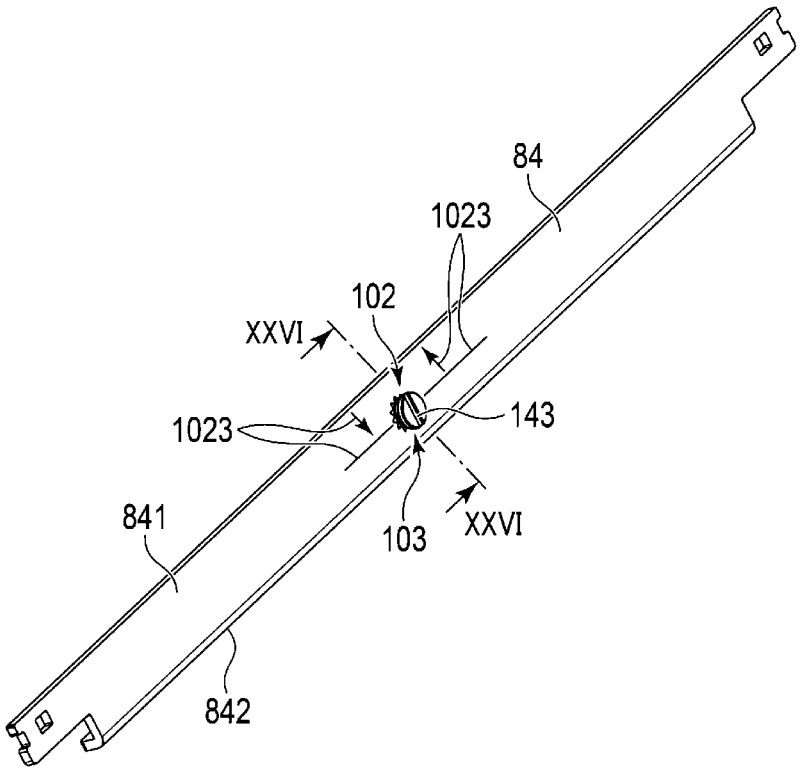
FIG. 25 is a schematic perspective view illustrating a positional relationship between the doctor blade and a sliding groove of the adjusting screw of the adjusting portion.
Figure 26:
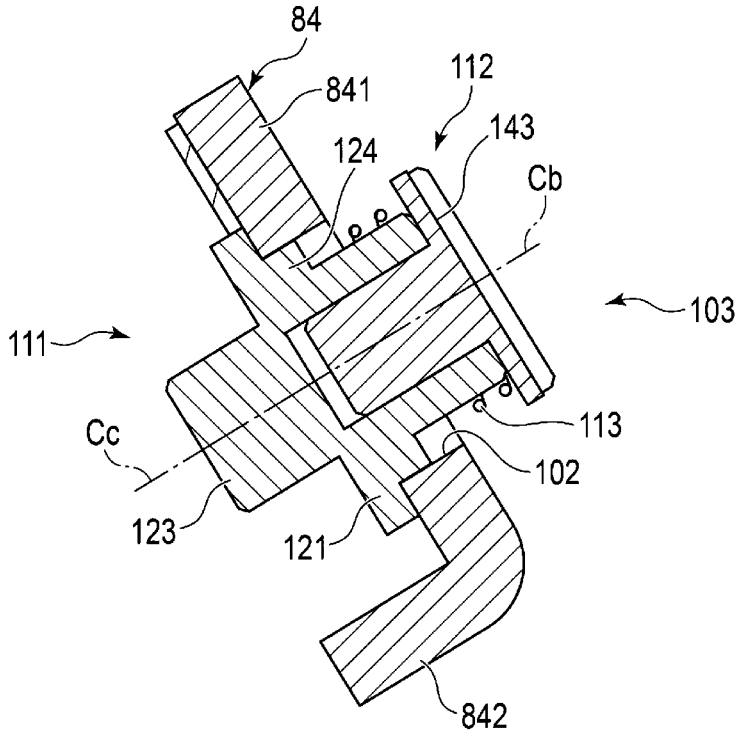
FIG. 26 is a cross-sectional view taken along the line XXVI-XXVI in FIG. 25.

FIG. 23 is a schematic perspective view illustrating the positional relationship between the doctor blade 84 and the sliding groove 143 of the adjusting screw 112 of the adjusting portion 103. FIG. 24 is a cross-sectional view taken along the line XXIV-XXIV in FIG. 23. FIG. 25 is a schematic perspective view illustrating the positional relationship between the doctor blade 84 and the sliding groove 143 of the adjusting screw 112 of the adjusting portion 103. FIG. 26 is a cross-sectional view taken along the line XXVI-XXVI in FIG. 25.

The distance between the doctor blade 84 and the outer surface of the developing sleeve 83 is adjusted by adjusting the position of the doctor blade 84 with respect to the developing case 81. The position of the developing sleeve 83 is not adjusted with respect to the developing case 81.

As illustrated in FIGS. 23 and 24, the first engaging portion 1022 and the second engaging portion 124 are engaged by the urging force of the adjusting spring 113. For example, the longitudinal direction of the sliding groove 143 of the adjusting screw 112 coincides with the longitudinal direction of the doctor blade 84. If an operator faces the surface of the blade portion 841 of the doctor blade 84 where the index portion 1023 is located, the longitudinal direction of the sliding groove 143 appears to be in line with the index portion 1023. The position of the sliding groove 143 at this time is set as an initial position.

Further, the gap between both end portions of the doctor blade 84 and the outer surface of the developing sleeve 83 at this time is defined as a predetermined gap. The distance between the central portion between both end portions of the doctor blade 84 and the outer surface of the developing sleeve 83 is defined as an initial gap. Then, the operator confirms the difference between the gap (the predetermined gap) between both end portions of the doctor blade 84 and the outer surface of the developing sleeve 83 and the gap (the initial gap) between the central portion between both end portions of the doctor blade 84 and the outer surface of the developing sleeve 83. If the difference between the predetermined gap and the initial gap is within a permissible range, no work is required by the operator. If the difference between the predetermined gap and the initial gap is out of the permissible range, the operator performs the following operations.

The operator uses a tool such as a flat-blade screwdriver to press the adjusting screw 112, that is, the adjusting portion 103 at the initial position toward the concave hole 101 against the urging force of the adjusting spring 113. While the tip of the cam 123 moves to the back side of the concave hole 101 with respect to the developing case 81, the second engaging portion 124 of the adjusting portion 103 and the first engaging portion 1022 of the through hole 102 are disengaged, and the adjusting screw 112, that is, the adjusting portion 103 can rotate around the central axis Cb of the rotating portion 122. The operator rotates the adjusting screw 112 in a state where the second engaging portion 124 of the adjusting portion 103 and the first engaging portion 1022 of the through hole 102 are disengaged. The maximum amount of rotation here is, for example, ±¼ rotation between the positions illustrated in FIGS. 23 and 24 and the positions illustrated in FIGS. 25 and 26.

Here, the length Lb of the opening of the concave hole 101 illustrated in FIG. 11 in the lateral direction coincides with the length to which the outer edge of the cam 123 fits. Further, the length La in the longitudinal direction of the opening of the concave hole 101 illustrated in FIG. 10 is longer than the length to which the outer edge of the cam 123 fits. The shape of the opening of the concave hole 101 is constant over a predetermined distance along the axial direction of the predetermined axis Cc of the cam 123. Therefore, the concave hole 101 has the same shape at the predetermined distance from the opening toward the back side along the predetermined axis Cc of the cam 123. Therefore, the concave hole 101 does not hinder the movement of the cam 123 along the axial direction of the predetermined axis Cc and the rotation of the cam 123.

At this time, it is assumed that the distance b−a≈33 μm, the distance c−a≈66 μm, the distance d−a≈100 μm (0.1 mm), the distance e−d≈33 μm, the distance f−d≈66 μm, and the distance g−d≈100 μm (0.1 mm) in FIGS. 20 and 22. Therefore, each time the adjusting screw 112, that is, the adjusting portion 103 is rotated ±1/12 with respect to the initial position, the doctor blade 84 approaches or separates from the outer surface of the developing sleeve 83 by approximately 33 μm with respect to the developing case 81. Similarly, if the adjusting screw 112 is rotated ±⅛ with respect to the initial position, the doctor blade 84 approaches or separates from the outer surface of the developing sleeve 83 by approximately 66 μm with respect to the developing case 81. Similarly, if the adjusting screw 112 is rotated ±¼ with respect to the initial position, the doctor blade 84 approaches or separates from the outer surface of the developing sleeve 83 by approximately 100 μm with respect to the developing case 81.

As described above, in the present embodiment, assuming that the adjusting screw 112 is rotated up to ¼ with respect to the initial position, as an example, approximately ±100 μm is the maximum adjustment width of the gap between the doctor blade 84 and the outer surface of the developing sleeve 83.

The operator performs the work so that the initial gap approaches the predetermined gap. The operator recognizes the adjustment amount with respect to the initial gap between the doctor blade 84 and the outer surface of the developing sleeve 83 based on the positional relationship between the sliding groove 143 of the adjusting portion 103 and the index portion 1023 in the vicinity of the through hole 102 illustrated in FIG. 23. Specifically, the operator recognizes the adjustment distance between the doctor blade 84 and the outer surface of the developing sleeve 83 depending on the direction in which the adjusting portion 103 is rotated and the direction in which the sliding groove 143 of the adjusting portion 103 faces. If the operator rotates the adjusting portion 103 clockwise, the distance between the outer surface of the developing sleeve 83 and the doctor blade 84 gradually decreases. If the operator rotates the adjusting portion 103 counterclockwise, the distance between the outer surface of the developing sleeve 83 and the doctor blade 84 gradually increases.

In this way, the doctor blade 84 is close to or separated from the outer surface of the developing sleeve 83 at the central portion between the both end portions, depending on the rotation direction of the adjusting portion 103. The operator stops the rotation of the adjusting portion 103 at a desired position. Then, the operator releases the state where the adjusting screw 112 is pressed toward the concave hole 101 against the urging force of the adjusting spring 113.

For example, it is assumed that the adjustment amount (for example, +¼ rotation or −¼ rotation) from the initial position illustrated by the adjusting portion 103 in FIGS. 23 and 24 to the position illustrated in FIGS. 25 and 26 is a desired adjustment amount that brings the initial gap closer to the predetermined gap. The desired adjustment amount is such that the distance between the doctor blade 84 and the outer surface of the developing sleeve 83 at the central portion between both end portions of the doctor blade 84 is within a permissible range of the predetermined gap. According to the urging force of the adjusting spring 113, the flange portion 142 of the adjusting screw 112 is separated from the doctor blade 84, and the second engaging portion 124 of the adjusting stud 111 engages with the first engaging portion 1022 of the doctor blade 84. At this time, the second engaging portion 124 does not rotate with respect to the first engaging portion 1022. Therefore, the positional relationship between the doctor blade 84 and the outer surface of the developing sleeve 83 is maintained.

The operator remeasures the distance (the predetermined gap) between the doctor blade 84 and the outer surface of the developing sleeve 83, and the distance (adjusted gap) between the central portion between both end portions of the doctor blade 84 and the outer surface of the developing sleeve 83. The operator confirms that the adjusted gap is within a permissible range with respect to the predetermined gap. The image forming apparatus 1 is shipped and used in this state. The operator may perform such work at the installation site of the image forming apparatus 1.

As a structure for adjusting the distance (gap) between the doctor blade 84 of the developing device 74 and the outer surface of the developing sleeve 83, all that is required is to form the concave hole 101 in the developing case 81, form the through hole 102 in the doctor blade 84, and prepare the adjusting portion 103. Therefore, substantially, the only component that needs to be newly prepared is the adjusting portion 103.

The blade portion 841 of the doctor blade 84 is formed so that the distance from the outer surface of the developing sleeve 83 has substantially the same straightness at any position along the longitudinal direction. If the distance between the blade portion of the doctor blade 84 and the outer surface of the developing sleeve 83 differs depending on the position in the longitudinal direction, in the related art, it was necessary to reattach the doctor blade 84 to the developing case 81 and replace the doctor blade 84.

In the developing device 74 according to the present embodiment, if the operator rotates the adjusting portion 103 with respect to the initial position, for example, by a maximum of ±¼ rotation, it is possible to move the doctor blade 84 with respect to the developing case 81 to adjust the distance (gap) between the doctor blade 84 and the outer surface of the developing sleeve 83. At this time, the distance between the blade portion of the doctor blade 84 and the outer surface of the developing sleeve 83 can be made substantially the same at any position in the longitudinal direction. In this work, the adjusting portion 103 that engages with the doctor blade 84 is pushed into the developing case 81 to release the engagement and is turned, and the pushing is released to re-engage the doctor blade 84 and the adjusting portion 103. Therefore, the work of the operator is easy.

Therefore, according to the present embodiment, it is possible to reduce the work time such as replacement of the doctor blade 84 and reduce the manufacturing time of the developing device 74 and the image forming apparatus 1.

As described above, according to the developing device 74 according to the present embodiment, by adjusting the position of the doctor blade 84 with respect to the developing case 81 according to the rotation of the rotating portion 122, the distance between the doctor blade 84 and the outer surface of the developing sleeve 83 can be adjusted. Therefore, according to the image forming apparatus 1 according to the present embodiment, by adjusting the position of the doctor blade 84 with respect to the developing case 81 according to the rotation of the rotating portion 122, the distance between the doctor blade 84 and the outer surface of the developing sleeve 83 can be adjusted. Therefore, according to the present embodiment, it is possible to provide the developing device 74 capable of adjusting the distance between the doctor blade 84 and the outer surface of the developing sleeve 83, and the image forming apparatus 1 including the developing device 74.

In the present embodiment, an example in which the adjusting stud 111 and the adjusting screw 112 are separated is described in order to dispose the adjusting spring between the adjusting stud 111 and the adjusting screw 112. As an example of fixing the adjusting screw 112 as a fixed body to the adjusting stud 111, various relationships can be used in addition to the relationship between the female screw portion 132 of the rotating portion 122 of the adjusting stud 111 and the male screw portion 141 of the adjusting screw 112. For example, the adjusting stud 111 and the adjusting screw 112 may be integrated. In this case, for example, the male screw portion 141 of the adjusting screw 112 as a fixed body is a columnar portion, and the female screw portion 132 of the adjusting stud 111 is, for example, a simple tubular body 131. By press-fitting the columnar portion of the fixed portion into the tubular body 131 of the adjusting stud 111, for example, the tubular body 131 of the adjusting stud 111 and the columnar portion of the fixed body are fixed. Alternatively, in a state where the columnar portion of the fixed portion is fitted into the tubular body 131 of the adjusting stud 111, the adjusting stud 111 and the fixed body are integrated by crimping the tubular body 131 of the adjusting stud 111 and the columnar portion of the fixed portion from the outside, for example. In this case, the rotating portion 122 and the fixed body (adjusting screw) 112 are formed as the rotating portion 122 including the flange portion 142.

The first engaging portion 1022 and the second engaging portion 124 are described as spline-shaped portions. As long as the positional relationship between the first engaging portion 1022 and the second engaging portion 124, such as a click mechanism, can be maintained, various relationships are allowed.

If an appropriate frictional force can be exerted between the base portion 121 of the adjusting portion 103 and the doctor blade 84, the first engaging portion 1022 and the second engaging portion 124 may be unnecessary.

The difference between the distances a, b, c, d, e, f, and g is an example and can be set appropriately. Therefore, the shape of the cam 123 is appropriately set. In the present embodiment, an example in which the adjusting portion 103 is rotated by ±¼ at the maximum is described. The amount of rotation is appropriately set according to the shape of the cam 123.

According to at least one embodiment described above, it is possible to provide the developing device 74 capable of adjusting the distance between the doctor blade 84 and the outer surface of the developing sleeve 83, and the image forming apparatus 1 including the developing device 74.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a developing case that houses a developer comprising a carrier and toner supplied from a toner cartridge;

a developing sleeve of which both ends are supported by the developing case and that the developer adheres to an outer surface thereof by magnetic force;

a doctor blade separated from the outer surface of the developing sleeve, having both end portions in a longitudinal direction fixed to the developing case, and including a through hole in a central portion in the longitudinal direction; and an adjusting portion that adjusts a distance between the doctor blade and the outer surface of the developing sleeve, wherein the adjusting portion comprises a plate-shaped base portion, a shaft-shaped rotating portion provided on one surface of the base portion and rotates with respect to the doctor blade and the developing case through the through hole, and a cam provided on the other surface of the base portion, fitting into the developing case, and adjusting a position of the doctor blade with respect to the developing case according to rotation of the rotating portion.

2. The image forming apparatus according to claim 1, wherein an outer edge of the cam is a collection of ends of a plurality of line segments having a predetermined length passing through a predetermined axis, a first line segment of the plurality of line segments has a same length between the predetermined axis and a first end as a length between the predetermined axis and a second end, and a second line segment of the plurality of line segments, which is different from the first line segment, has a different length between the predetermined axis and a third end from a length between the predetermined axis and a fourth end.

3. The image forming apparatus according to claim 1, wherein the developing case includes a substantially rectangular opening having a short side that receives the outer edge of the cam and a long side longer than the short side, and a concave hole into which the cam is fitted through the opening.

4. The image forming apparatus according to claim 1, wherein the adjusting portion includes an urging body that urges a side of the rotating portion separated from the base portion in a direction away from the doctor blade.

5. The image forming apparatus according to claim 4, wherein the rotating portion includes a tubular body having a female screw portion around a rotation axis of the rotating portion, and an adjusting screw screwed into the female screw portion, and the urging body is supported between a head portion of the adjusting screw and the doctor blade.

6. The image forming apparatus according to claim 5, wherein the base portion, the cam, and the tubular body of the rotating portion are integrated.

7. The image forming apparatus according to claim 4, wherein the urging body includes a compression coil spring disposed between the rotating portion on a side away from the base portion and the doctor blade.

8. The image forming apparatus according to claim 1, wherein the through hole includes a circular hole and a first engaging portion that surrounds an outside of the circular hole and has a plurality of irregularities along a circumferential direction, and the adjusting portion includes a second engaging portion that engages with the first engaging portion between the rotating portion and the base portion.

9. The image forming apparatus according to claim 8, wherein the first engaging portion and the second engaging portion each have a spline-shaped portion that engages with each other.

10. The image forming apparatus according to claim 1, wherein the rotating portion and the doctor blade have an index portion that indicates an adjustment amount with respect to an initial gap between the doctor blade and the outer surface of the developing sleeve.

11. A developer handling system for an image forming apparatus, comprising:

a developing case that houses a developer comprising a carrier and toner supplied from a toner cartridge;

a developing sleeve of which both ends are supported by the developing case and that the developer adheres to an outer surface thereof by magnetic force;

a doctor blade separated from the outer surface of the developing sleeve, having both end portions in a longitudinal direction fixed to the developing case, and including a through hole in a central portion in the longitudinal direction; and an adjusting portion that adjusts a distance between the doctor blade and the outer surface of the developing sleeve, wherein the adjusting portion comprises a plate-shaped base portion, a shaft-shaped rotating portion provided on one surface of the base portion and rotates with respect to the doctor blade and the developing case through the through hole, and a cam provided on the other surface of the base portion, fitting into the developing case, and adjusting a position of the doctor blade with respect to the developing case according to rotation of the rotating portion.

12. The developer handling system according to claim 11, wherein an outer edge of the cam is a collection of ends of a plurality of line segments having a predetermined length passing through a predetermined axis, a first line segment of the plurality of line segments has a same length between the predetermined axis and a first end as a length between the predetermined axis and a second end, and a second line segment of the plurality of line segments, which is different from the first line segment, has a different length between the predetermined axis and a third end from a length between the predetermined axis and a fourth end.

13. The developer handling system according to claim 11, wherein the developing case includes a substantially rectangular opening having a short side that receives the outer edge of the cam and a long side longer than the short side, and a concave hole into which the cam is fitted through the opening.

14. The developer handling system according to claim 11, wherein the adjusting portion includes an urging body that urges a side of the rotating portion separated from the base portion in a direction away from the doctor blade.

15. The developer handling system according to claim 14, wherein the rotating portion includes a tubular body having a female screw portion around a rotation axis of the rotating portion, and an adjusting screw screwed into the female screw portion, and the urging body is supported between a head portion of the adjusting screw and the doctor blade.

16. The developer handling system according to claim 15, wherein the base portion, the cam, and the tubular body of the rotating portion are integrated.

17. The developer handling system according to claim 14, wherein the urging body includes a compression coil spring disposed between the rotating portion on a side away from the base portion and the doctor blade.

18. The developer handling system according to claim 11, wherein the through hole includes a circular hole and a first engaging portion that surrounds an outside of the circular hole and has a plurality of irregularities along a circumferential direction, and the adjusting portion includes a second engaging portion that engages with the first engaging portion between the rotating portion and the base portion.

19. The developer handling system according to claim 18, wherein the first engaging portion and the second engaging portion each have a spline-shaped portion that engages with each other.

20. The developer handling system according to claim 11, wherein the rotating portion and the doctor blade have an index portion that indicates an adjustment amount with respect to an initial gap between the doctor blade and the outer surface of the developing sleeve.

* * * * *